United States Patent [19]

Mauer

[11] Patent Number: 4,807,455

[45] Date of Patent: Feb. 28, 1989

[54] ELECTROMAGNETICALLY BLOCKING AND UNBLOCKING A LOCK FOR A SAFETY DEPOSIT BOX, STRONG BOX OR THE LIKE

[75] Inventor: Guenter Mauer, Heiligenhaus, Fed. Rep. of Germany

[73] Assignee: Mauer GmbH, Heiligenhaus, Fed. Rep. of Germany

[21] Appl. No.: 946,972

[22] Filed: Dec. 29, 1986

[30] Foreign Application Priority Data

Dec. 28, 1985 [DE] Fed. Rep. of Germany ..... 3546241

[51] Int. Cl.[4] ..... E05B 47/00

[52] U.S. Cl. ..... 70/277; 70/279

[58] Field of Search ..... 70/279, 277, 284, 237, 70/239, 355

[56] References Cited

U.S. PATENT DOCUMENTS 3,796,073 3/1974 Giuraud ..... 70/134
4,003,564 8/1986 Kleinhany ..... 70/277
4,656,852 4/1987 Deschamps ..... 70/277

FOREIGN PATENT DOCUMENTS 2918788 11/1980 Fed. Rep. of Germany .
3209751 9/1983 Fed. Rep. of Germany ..... 70/277

*Primary Examiner*—Robert L. Wolfe
*Attorney, Agent, or Firm*—Ralf H. Siegemund

[57] ABSTRACT

The latch bolt of a lock is prevented from fully retracting when an electromagnet is unenergized so that a blocking lever carrying the armature can pivot about a pivot point displaced from the armature and a slide or lever pivotally linked to the blocking lever places a blocking nose; when the electromagnet is energized the blocking lever pivots on the armature and thereby moves the slide or lever out of the track of that pin. The armature is normally held against the electromagnet by a spring so that very little electric power is needed and only in case of a desired lock release.

10 Claims, 5 Drawing Sheets

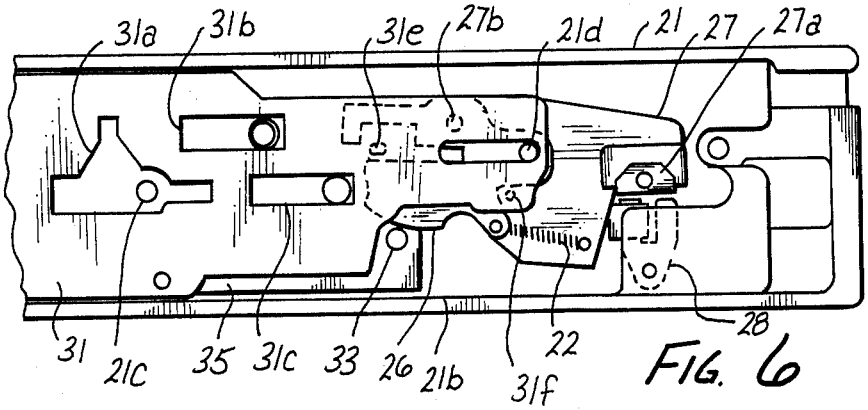
FIG. 6
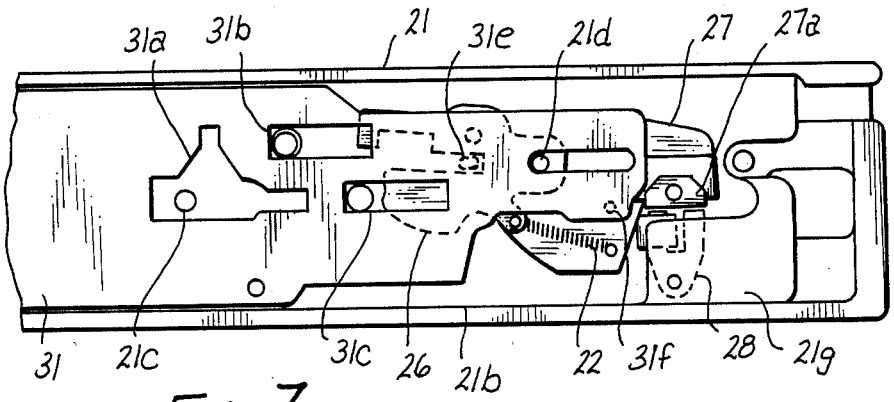
FIG. 7
FIG. 8
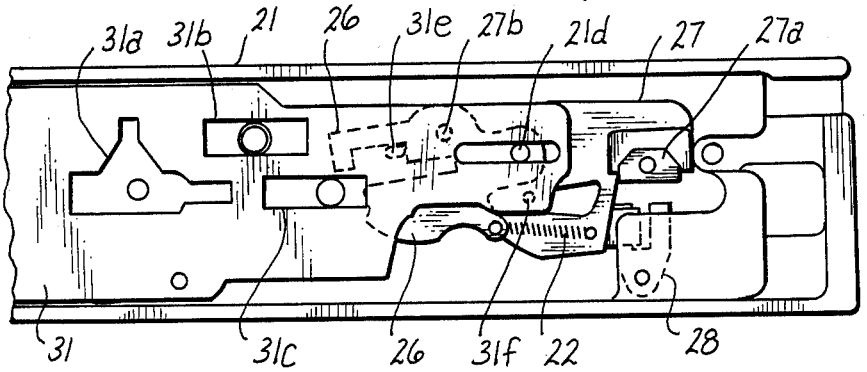

ELECTROMAGNETICALLY BLOCKING AND UNBLOCKING A LOCK FOR A SAFETY DEPOSIT BOX, STRONG BOX OR THE LIKE

BACKGROUND OF THE INVENTION

The present invention relates to an electromagnetically controlled strong box, safety deposit box or the like with encoded unlocking as well as handle means for operating a latch or a dead bolt, and in particular the invention refers to locking a strong box or safety deposit box of the foregoing type having a housing with a suitable recess to receive both the latch bolt and the lock itself.

Locks of the type used in a strong or safety deposit box as per the invention are known in a variety of a configurations. For example safety deposit boxes in banks or bank vaults use lock which include six or seven lock elements (locking pins, tumblers). The customer i.e. the lessee of the safety deposit box is the only one who has control over the respective key. In order to avoid misuse of stolen or lost keys the lock is additionally equipped with an electromagnet whose armature actuates a locking pin which projects into the path of the locking e.eg. the dead bolt. The energization circuits of the electromagnets for all of the various safety deposit boxes in the vault of the bank are monitored by a employee of the bank at a station provided for that purpose. It is his task to check on the identity and authorization of any user of the key. Having satisfied himself he unlocks the electromagnetic blocking mechanism for that particular box. It is inherent that a lock of this kind and here particularly the electromagnet undergoes a certain stroke which in turn requires a minimum volume of occupancy.

Another kind of strong box or the like is known wherein a secret code has to be keyed in and only if the entered code is the correct one will a blocking electromagnet cause a release of the lock; a blocking pin is removed and now the box can be opened and unlocked in the usual fashion. Also here the magnet is required to move over a certain path lengths and is required to consume a certain amount of power so that in fact the blocking pin can be removed by electromagnetic forces.

DESCRIPTION OF THE INVENTION

It is an object of the present invention to provide a new and improved electromagnetic unblocking structure for strong boxes, safety deposit boxes or the like in which the construction is such that the volume occupied by the magnet and its movable parts is reduced and to reduce the electrical power consumption so that particularly in the case of a large number e.g. of safety deposit boxes the amount of electrical current consumed is drastically minimized.

It is another object of the present invention to improve electromagnetic operation of strong boxes, safety deposit boxes or the like as outlined above and to configure supplemental and additional elements and components such as magnets, levers slides and the entire electromagnetic arrangement can be accommodated in lock housings of conventional design without requiring re-design and reconstruction of the mechanical lock itself.

In accordance with the preferred embodiment of the present invention, it is suggested to provide a rearside opening in the box housing, casing or the like and to place an electromagnet therein having an armature which sits on a blocking lever being provided with a control slot and owing to the force of a spring the armature abuts the yoke of the electromagnet; the blocking lever is pivotably mounted on a control slide or lever and an actuator pin being e.g. operated manually will pivot the blocking lever about its axis when the electromagnet is not energized until this control pin runs against a blocking nose of the control slide or lever while for energized electromagnet the blocking lever is pivoted about the armature it carries and the control lever or slide is placed into a release or unblocking position.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 6 illustrates a front view of a lock for a safety deposit box for a bank in blocked and locked position;

FIG. 7 illustrates the lock shown in FIG. 6 but in open position;

FIG. 8 illustrates the same device pursuant to an attempt to opening without preparatory electromagnetic energization;

Proceeding now to the detailed description of the drawings, FIG. 1 illustrates the rear side of a lock and key housing 1 made through injection molding; the housing has four round fastening openings or boxes 2,3,4 and 5. A roughly crosslike indent 1*a* receives a control switch and a blocking lever 7. An armature 7*a* is fastened to the left side of the lever 7. The armature 7*a* cooperates with and faces a yoke of an electromagnet 8*a* which is secured to case 1. The two arm lever 7 is pivotally mounted on slide 6 by means of a pin 9. A tension spring 12 pulls lever 7 into a first terminal position in which the armature 7*a* directly abuts the magnet 8.

Figure 1:
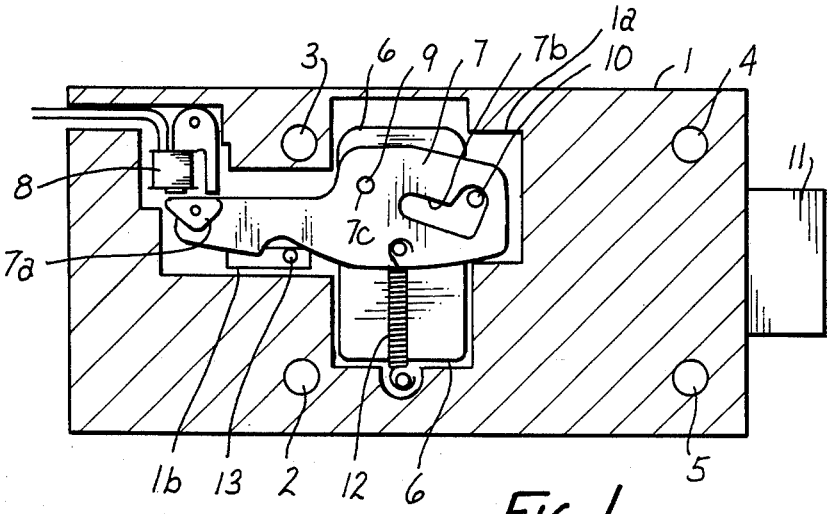
FIG. 1 is an elevation of the rear of a code combination lock and key for a safety deposit or strong box; the device being shown in blocking position.

A control and actuation pin 10 sits on a pivot lever (not shown) for direct actuation of the dead or latch bolt 11. This pin 10 traverse openings in the slide 6 and lever 7, part 6 and 7 are in an overlaid position accordingly. It should be noted that the locking-unlocking mechanism and specifically or generally for the lock is conventional and not part of the invention. It is thus assumed that in a conventional manner latch bolt 11 can be moved and that, as an accompanying action, pin 10 is being moved. The inventor is concerned with conditions permitting or preventing that latch bolt actuation.

Figure 2:
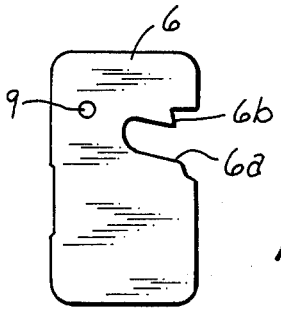
FIG. 2 illustrates in plan view a slidable control element used in the device shown in FIG. 1.
Figure 3:
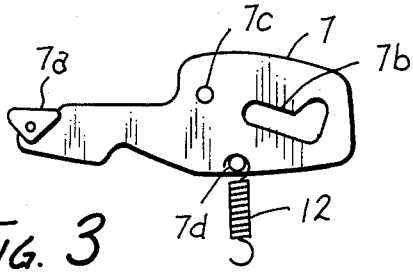
FIG. 3 illustrates in plan view the blocking lever used in the device shown in FIG. 1.

FIG. 2 illustrates the slide lever 6 in detail. It carries the pin in the upper left and in the upper right portion slide 6 is provided with an opening or recess *6a* which merges into a blocking nose *6b*. FIG. 3 as stated shows the blocking lever 7 with the armature *7a*. Also seen is an angled off control slot *7b* and a mounting (fastening) bore *7c*. The recess *6a* of slide 6 (FIG. 2) and the slot *7b* in lever 7 are aligned when parts 6 and 7 are overplaced so as to be traversed by the actuation pin 10. A fastening pin *7d* is provided on lever 7 for holding the tension spring 12 such that the spring tends to turn lever 7 in clockwise direction as seen in this particular drawing. However spring 12 also pulls the lever 6 into its lower end position owing to pin 9 of 6, being inserted in *7c* of 7.

Figure 4:
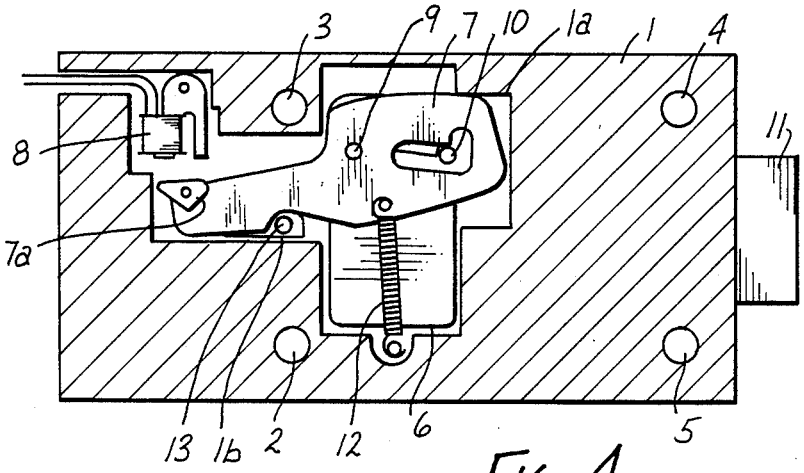
FIG. 4 is a view similar to FIG. 1 but showing the parts for unauthorized attempt to open the lock without preparatory energization of the electromagnetic device.

If someone attempted to pull back manually the latch bolt 11 while the electromagnet 8 is not energized then the control and actuation pin 10 will move on its path toward the left and will cause the lever 7 to pivot in counterclockwise direction (FIGS. 1 and 3). The electromagnet will not resist this attempt and armature *7a* can indeed be pulled away from the magnet's yoke. The axis of turning of lever 7 is now the pin 9. The armature *7a* is therefore pulled away from the magnet 8 until the control and actuation pin 10 abuts the blocking nose *6b* of slide 6. In this stage the element 11 retracted only for a short distance as shown in FIG. 4. Thus it can be seen that the attempt to pull latch bolt 11 back is futile. A soon as the manual actuation is released the spring 12 will pull the lever 7 against the magnet 8.

Figure 5:
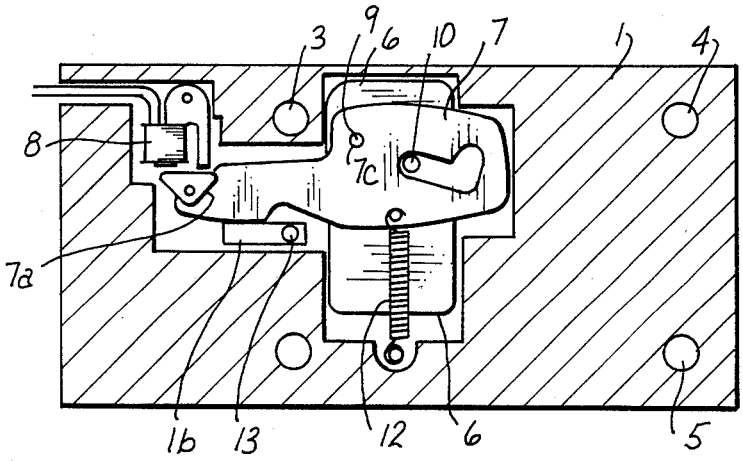
FIG. 5 shows a top view of the device in FIG. 1 but in open position.
Figure 9:
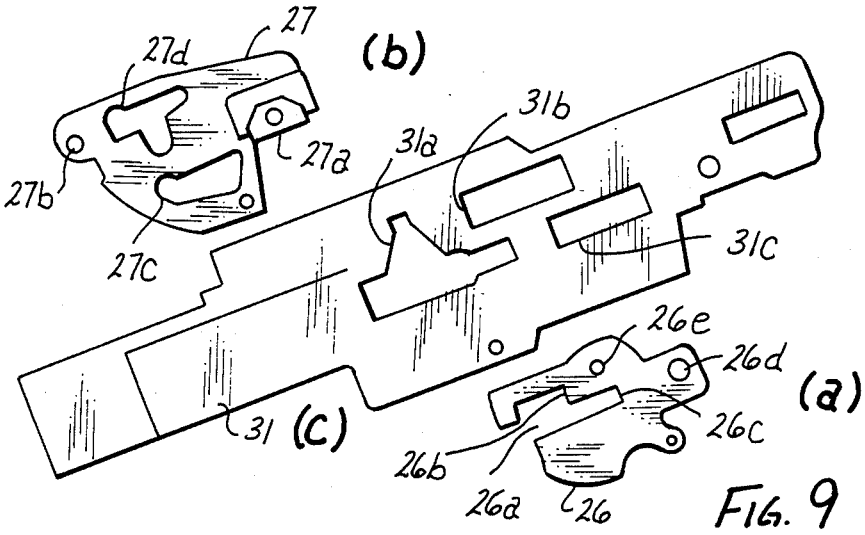
FIG. 9*a,b* and *c* are plan views of several individual parts used in the device shown in FIGS. 6–8.

The system behaves differently if prior to opening the lock an electromagnet 8 is energized as a preparatory step. Here the control and actuation pin 10 forces slide 6 as well as lever 7 in up direction (FIG. 1) and the pin fastening the armature *7a* on lever 7 now serves as pivot point. Therefore, the control and actuation pin 10 passes over the blocking nose *6b* and moves into a left hand end position, and latch bolt 11 is fully retracted by this manipulation. For this to take place, however, it is necessary that the armature 8 holds the abutting armature *7a* so that it rather than pin 9 is the pivot point for lever 7. Only very little power is needed to hold armature *7a* as compared to the usual lift stroke operation in known locks. The open lock is depicted in FIG. 5.

During normal (authorized, legitimate) operation the user will merely key-in the secret code; there may be an inherent delay whereupon the latch bolt 11 is pulled back manually through. In order to lock the lock again the manual device has to be turned back into closing position. Here pin 10 will move to the right (FIG. 5, 4) until slide 6 drops and will block again the pin 10.

Manual operation uses a manipulator that includes a handle, a stem and a second hook. The front side of the lock has a simple key hole. The lock cover is fastened back to the casing after the manipulator has been inserted but at a particualr angle and now it will require a tool to remove the handle. This is not shown but conventional for key-code operated strong boxes.

Should there be a power failure (the power needs are a few volts d.c.) or if the code number is not the correct one or the user has forgotten what the code is then, it is suggested to provide an emergency opening facility. This facility includes an emergency key to be inserted in lieu of the now removed manipulating device, further included is an emergency latch with a pin 13 thereon. This pin 13 moves in slot *1b*, to the left (FIG. 5) and will slip under the armature *7a* so that upon further turning of the emergency key the armature is in fact held in abutting position with the electromagnet, and now latch bolt 11 can be retracted in a normal fashion.

Prior to the utilization of the emergency key it will be necessary (a) to remove the lock of the key hole cover and (b) to turn the key about an angle of 120 degrees so that (c) the manipulator can be removed and (d) the emergency key can be inserted in lieu thereof. The emergency key includes a latch hook on one side and a contoured key bit on the other side so that the usual six or seven tumbler elements can be employed. These tumblers, however, are connected only to the normally covered latch bolt while the main latch bolt 11 is locked electromagnetically.

The latching and blocking system as described is not only usable for a strong box of the type mentioned above but also in safety deposit boxes in bank vaults wherein an employee is required to unblock the blocking system through electromagnetic actuation. The customer will then be able to open his own box with his key. The customer key is a two bit key which engages the normal lock part having six or seven tumblers as locking and bolt actuating elements.

The term "manipulator" is thus to be interpreted in a wide sense and in addition to a handle or turning knob it may include also normal keys particularly two bit keys which are able to move the lock tumblers and are particularly capable of transmitting the requisite torque for retraction of the latch.

Deviating from the particular embodiment described above, the slide 6 may be replaced by a control lever. This reduces the construction volume as well as simplifies the contouring of openings of housing.

The electromagnet 8 is required merely to hold the armature *7a;* its volume and weight is considerably smaller than magnets of prior art design, because the prior art lock blocking/unblocking magnets are required to exert permanently or considerably a means of force. Presently, all that is required for the magnet is to hold its armature during authorized or legitmate lock use, just to shift the pivot point for lever 7 from 9 to *7a*. Energizing this electromagnet requires merely a few volts d.c. Thus, one may operate the device with maintenance-free long lasting batteries. The electromagnet 8 is, in fact, placeable in just a usual housing.

The aforedescribed device is quite economical and hardly prone to interference and in this regard favorably compares with the prior art. If the unlikely event occurs that the electronic of the electronic key is down or there is a power failure then a mechanical emergency system is provided for as described and wherein the emergency key has the usual six or seven tumbler elements including the requisite safety standards that have to be observed.

The lock described thus far was described as assumed to be a code-combination lock with the main parts being in the front while all parts of the electrical blocking/unblocking control are basically in the rear of the lock casing. This facilitates assembly and permits adjusting an optical visual control and inspection prior to insertion.

FIGS. 6–11 describe a lock for safety deposit box in a bank wherein the control and the lock levers are actually accommodated by the main opening or interior of the lock casing while the electromagnet and a microswitch are inserted through a rear opening. That microswitch signals back the operating state of the lock and blocking device.

FIG. 6 is a partial view of the lock casing 21 having a front opening 21*b* through which the following parts are inserted and installed in sequence. A separate bank lock with a latch or dead bolt 35; a customer or main latch bolt 31, and a customer lock; the last one was omitted in the illustration of FIG. 6–8 so that the main latch bolt 31 becomes fully visible. Reference numeral 31*a* refers to a cam curve for key. 21*c* is the key guiding pin while 31*b, c, d* are guide slots. A control pin 31*e* extends from the latch bolt 31 towards the back and another control pin 31*f* extends also towards the back. Control pin 31*e* has a blocking function analogous to pin 10 in FIGS. 1 to 5.

A control and actuation pin 33 sits directly on the bank latch bolt 35. A control lever 26 and a blocking lever 27 are arranged below the plane of the latch 31. The blocking lever 27 carries an armature 27*a* pertaining to an electromagnet 28 which, in the illustration, is covered by the wall 21*g*. A tension spring 22 is mounted to the levers 26 and 27 to hold armature 27*a* against magnet 28. Since the latch bolt 35 is placed as shown in the open position (right hand end position) pin 33 forces the lever 26 in up direction. Now the latch bolt 35 is (legitimately) moved to the left, spring 22 pulls lever 26 down until abutting with its cutout 26*a* against the control pin 31*e*; this is the blocking position. The critical parts for blocking are the levers 26 and 27; they are shown as being covered by the latch bolt 31 and will be described later in greater detail.

FIG. 6 shows the latch bolt 31 in the left hand end position so that the non-illustrated door or key etc. is actually locked. Owing to the force of the spring 22 the armature 27*a* bears against the yoke of the electromagnet 28. FIG. 7 illustrates the latch bolt 31 to be fully retracted and the lock is open. Upon opening, i.e. latch bolt retraction, armature 27*a* is held by the then energized magnet 28. FIG. 8 illustrates an attempt to open the lock without energization of electromagnet 28. The lever 27 is pivoted in upward direction by operation of the control pin 31*f*, but the lever 26 remains in blocked position and control pin 31*e* forces aborting the opening attempt.

FIG. 9*a* illustrates the control lever 26. The lever 26 is provided with a cut out or opening 26*a* within which pin 31*e* can move. On release pin 31*e* runs, in accordance with FIG. 7, towards an end edge 26*c* of cut out 26*a*. Upon blocking pin 31*e* hits, as shown in FIG. 8, against the blocking nose 26*b*. A bore 26*d* receives around a stationary mounting pin 21*d* being fixed to the case of the lock. The second bore 26*e* receives a pin 27*b* of the lever 27. Thus pin 27*b* is also shown in FIG. 9*b*. The lever 27 is further provided with a control cam 27*c* as well as an opening 27*d*. The control pin 31*f* acts on the cam surface 27*c*. An opening 27*d* is disposed in the area of and is traversed by the stationary mounting pin 21*d*. FIG. 9*c* shows the latch bolt 31 together with the various openings mentioned already. Cutout 31*a* establishes a control cam for the pin 21*c* of the key; 31*b* and *c* are guide slots cooperating with stationary pins for holding the latch bolt 31 straight.

Figure 10:
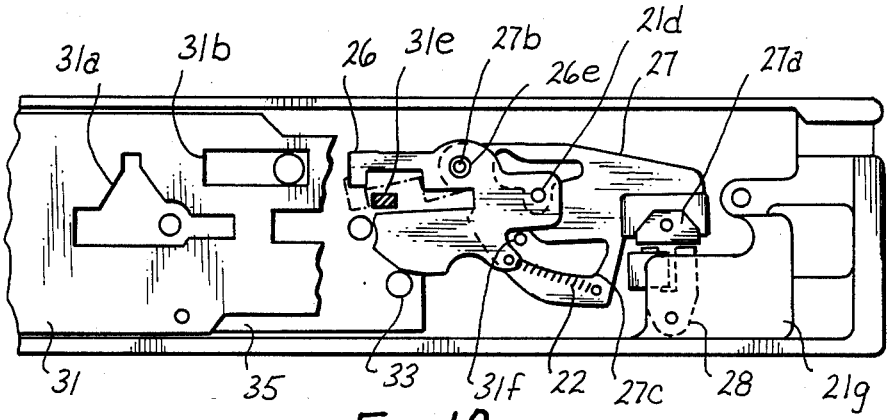
FIG. 10 is a partial internal view of the device shown in FIG. 6.

The cooperation of levers 26, 27 and of latch bolts 35 on the other hand are discernible from FIG. 10. The bank latch bolt 35 is shown in retracted, door opening position. Its pin 33 has forced the lever 26 in the release posiiton in the upward direction. Upon closing the latch bolt 35 lever 26 moves into the blocking position as indicated in dash dot lines. If now armature 27*a* is held electromagnetically against magnet 28 and the latch bolt 31 moves to the right for opening then pin 31*f* pivots the lever 27 and through the connection 27*b*, 26*e* the lever 26 is pivoted in clockwise direction so that the control pin 31*e* is no longer blocked. On the other hand if the magnet 28 is unenergized then the blocking lever 27 will turn counterclockwise about pin 27*b* armature 27*a* disengages from the magnet and the lever 26 remains in blocking position.

If now the door of the box is closed the latch bolt 31 moves to the left (still FIG. 10) and the force of spring 22 pivots lever 26 back into the blocking position. The spring 22 causes armature 27*a* in resting position to bear against the yoke 28 even though the magnet is no longer energized. This means that upon later energization one really does not have to move electromagnetically the armature 27*a* because the armature is normally held in a position which will then be retained electromagnetically. Since no lift stroke is to be made nor any air gap to be bridged so that the power is smaller by several orders of magnitude as compared to the ordinary lifting magnets.

Figure 11:
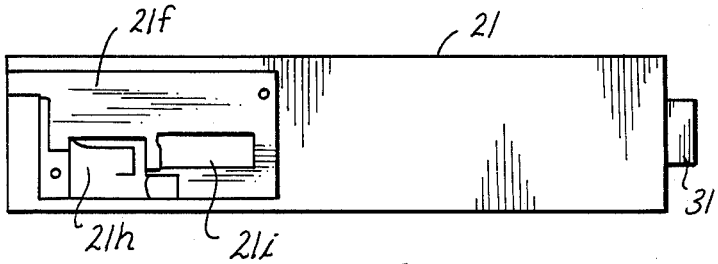
FIG. 11 is the rear view of a safety deposit box with the lock shown in FIG. 6–10 but on a smaller scale.

FIG. 11 shows the rear of the casing 21. The main latch bolt 31 projects here from the right. The left part of the casing 1 illustrates the recess 21*f*. The surfaces 21*h* and 21*i* are actually perforations through which extend levers and pins. The indentation 21*f* receives specifically the electromagnet for releasing the main latch bolt 31 operated by the customer's key.

Figure 12:
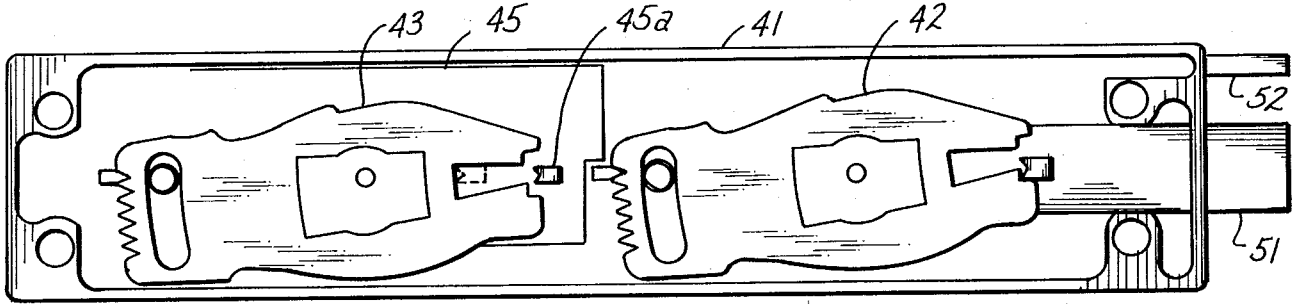
FIG. 12 is a front view of another safety deposit box.
Figure 13:
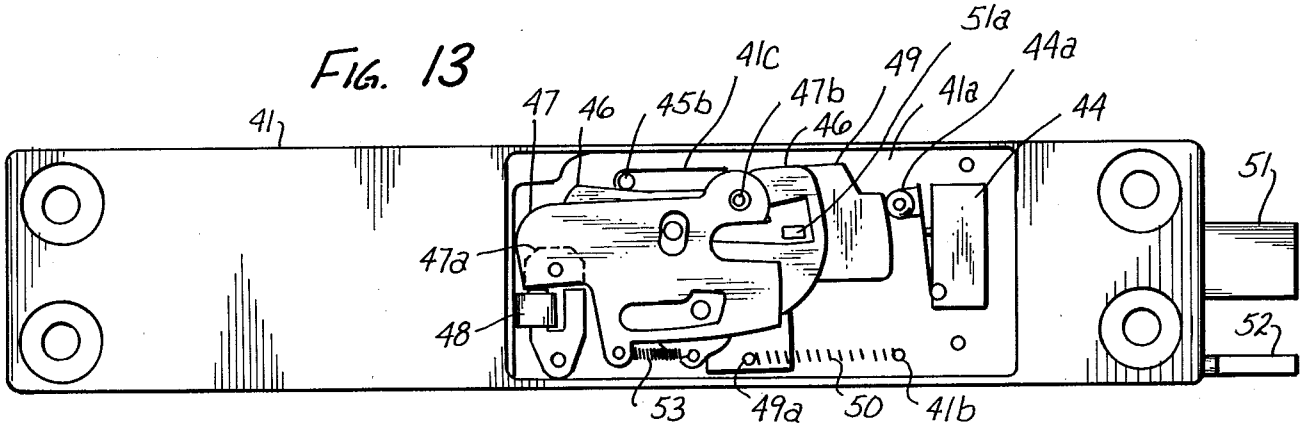
FIG. 13 is a rear-view of the safety deposit box shown in FIG. 12.

FIGS. 12 and 13 show another safety deposit box; a longitudinal casing 41 has a customer lock 42 and a similarly secured bank lock 43. Both locks are adjustable as to tumbler continuation. A bank latch bolt 45 is disposed underneath the bank lock 43 and in the plane of the main (customer) latch 51. The latch bolt 45 when in blocking position makes it impossible that the main latch bolt 51 be retracted. In other words, the two latch bolts 45 and 51 do not act in parallel, independently as bolts for the lock, but serially in that the retraction of bolt 51 requires that latch bolt 45 be retracted first. 45*a* is a control pin pertaining to the bank latch bolt 45. The release position of the control pin 45*a* is indicated by dashed lines. A trap 52 can also emerge from the right hand side of the casing in addition to the main latch bolt 51. The trap 52 is used for control purposes.

FIG. 13 shows the rear view of the casing 41 with a recess or indent 41*a*. A control lever 46, a blocking lever 47 and a magnet 48 are all disposed in that recess 41*a*. The armature 47*a* of the magnet 48 is connected to the lever 47. Just as before and in analogous fashion, the latch bolt 51 can be retracted when armature 47*a* remains in abutment with electromagnet 48 so that the pivotal linkage pin 47*b* between the levers 46 and 47 moves up and bolt 51 can be shifted all the way back without a blocking nose of lever 46 impeding a control pin 51*a*.

A pivot lever 49 being provided with a control cam for operating a microswitch 44. A pin 49*a* on lever 49 holds one end of the tension spring 50 whose other end is held stationary in relation to the casing by means of a fixed pin 41*b*. Upon inserting the trap 52 pivot lever 49 swivels in clockwise direction until a sensing lever 44*a* of microswitch 44 runs over the control edge of pivot lever 49 and operates the contact of the switch 44.

The contact of the microswitch may for example serve to trigger a signal in a station of the bank if the customer has accidentally moved the main latch bolt 51 into latching position without having closed the door of the safety deposit box properly. An alarm may be triggered if the lock is forced open without operating the latch bolts. Locks without traps may have a microswitch which simply signal the disposition of the main latch bolt for any purpose.

A control pin 45*b* extends through a slot 41*c* in the housing and is actuated (moved) by forward extension of the bank latch 45 (shown in FIG. 12). In the left hand retracted position of this control pin 45*b* the control lever 46 is forced against the force of the spring 53 into the illustrated release position. The bank lock can also act as an emergency opening system in case the electromagnetic unblocking fails.

The illustrated examples for strong boxes, safety deposit boxes or the like are only insignificantly more expensive than mere mechanical locks and can be used in a wide variety of circumstances not only in banks but in hotels, businesses etc.. Owing to the very limited current consumption one can use inexpensive drive batteries and that saves also installation cost.

The invention is not limited to the embodiments described above but all changes and modifications thereof, not constituting departures from the spirit and scope of the invention, are intended to be included.

I claim:

1. Electromagnetically operated blocking/unblocking of locks for strong boxes, safety deposit boxes or the like under utilization of operating means for protracting and retracting a latch bolt, there being a housing having an opening for passage of the latch bolt, the housing being sufficient for accomodating at least one lock comprising:

an electromagnet mounted in the rear of the housing and having an armature being seated on a blocking lever;

spring means urging said armature against a yoke of the electromagnet;

means being a control lever or a slide for pivotal mounting said blocking lever, said means for pivoted mounting having a blocking nose; and a control pin moved upon operating the lock, for pivoting the blocking lever about an axis spaced from the armature whenever the electromagnet is not energized, until said control pin runs against the blocking nose of said control slide or control lever thereby preventing retraction of the latch bolt, upon energizing said electromagnet the movement of the control pin causes the blocking lever to be pivoted about said armature permitting said control switch or lever to assume a latch bolt releasing disposition permitting retraction thereof.

2. Electromagnetically operated lock as in claim 1, wherein said axis for pivoting said blocking lever is established by a pin plus bore linkage, one of the latter pin and of the bore being on the blocking lever the other one on the control side or lever.

3. Electromagnetically controlled lock as in claim 1 said control pin being mounted to said latch bolt, said block lever having a control slot traversed by the control pin for causing said blocking lever to pivot upon retracting of the latch bolt.

4. Electromagnetically operated lock as in claim 1 including emergency key means, for actuating an auxiliary pin for being placed under the blocking lever so that the armature 7a is forced against and remains in abutment with the electromagnet to thereby permit release of the latch bolt without energization of the electromagnet.

5. Electromagnetically operated lock as in claim 1 there being a second lock arranged underneath in said housing having also a bolt, a pin or said latch bolt of said second lock and when retracted holding said armature against the magnet.

6. The lock as in claim 5 including a microswitch operated by the second latch bolt.

7. The lock as in claim 1 wherein said control lever or slide as pivoted on said blocking lever is moved or pivoted into a blocking position for said control pin upon pivoting of the blocking lever on said axis, but the control pin clears the blocking position when said blocking lever pivots on said armature, thereby pivoting or sliding the control lever or slide into a position permitting the control pin to clear.

8. Electromagnetically operated blocking/unblocking for locks of strong boxes, safety deposit boxes or the like, there being a housing for the lock and a latch bolt operated by the lock for protection and retraction, comprising:

an electromagnet in the housing being normally unenergized, but energized for unblocking of the lock;

a pivotal blocking lever carrying an armature for the electromagnet, the lever permitted to pivot on the armature;

a slide element pivotally linked to said blocking lever, said that the blocking lever can pivot on the slide element, or is moved with the slide element while pivoting on the armature for energized electromagnet;

control pin means on the latch bolt traversing a cam slot in the blocking lever for moving therein when the latch bolt is retracted; and a blocking nose on the slide element being disposed to project into the path of the control pin when the blocking lever is caused to pivot on the pivot on the slide element, but being moved out of the way of the control pin means when the blocking lever pivots on the armature and thereby slides the slide element.

9. Electromagnetically operated blocking/unblocking for locks of strong boxes, safety deposit boxes or the like, there being a housing for the lock and a latch bolt operated by the lock for protraction and retraction, comprising:

an electromagnet in the housing being normally unenergized but energized for unblocking of the lock;

a pivotal blocking lever carrying an armature for the housing, the lever permitted to pivot on the armature;

a pivotal control lever pivotally linked to said blocking lever such that the blocking lever can pivot on the control lever or is moved with the control lever while pivoting on the armature for energized electromagnet;

control pin means on the latch bolt traversing a cam slot in the blocking lever for moving therein when the latch bolt is retracted; and a blocking nose on the control lever being disposed to project into the face of a control pin of the pin means when the blocking lever is caused to pivot on the pivot on the control lever, but being moved out of the way of the control pin then the blocking lever pivots on the armature and thereby pivots the control lever.

10. The lock as in claim 9, wherein the control pin means includes a first pin and a second pin on the latch bolt, the first pin causing the blocking lever to pivot upon retraction of the latch bolt, the second pin being said control pin of the pin means.

* * * * *